US007509994B2

(12) United States Patent
Aoyama et al.

(10) Patent No.: US 7,509,994 B2
(45) Date of Patent: Mar. 31, 2009

(54) DEVICE FOR REMOVING SAND FROM CASTING

(75) Inventors: Yoshitaka Aoyama, 20-11, Makitsukadai 2-cho, Sakai-shi, Osaka 590-0114 (JP); Shoji Aoyama, Osaka (JP)

(73) Assignee: Yoshitaka Aoyama, Osaka (JP)

( * ) Notice: Subject to any disclaimer, the term of this patent is extended or adjusted under 35 U.S.C. 154(b) by 0 days.

(21) Appl. No.: 10/548,602

(22) PCT Filed: Mar. 17, 2004

(86) PCT No.: PCT/JP2004/003593

§ 371 (c)(1),
(2), (4) Date: Aug. 10, 2006

(87) PCT Pub. No.: WO2004/082870

PCT Pub. Date: Sep. 30, 2004

(65) Prior Publication Data

US 2007/0034348 A1 Feb. 15, 2007

(30) Foreign Application Priority Data

Mar. 17, 2003 (JP) ..... 2003-072188

(51) Int. Cl.
*B22D 29/02* (2006.01)

(52) U.S. Cl. ..... 164/404; 164/344; 164/131

(58) Field of Classification Search ..... 164/131–132, 164/260, 344–346, 404
See application file for complete search history.

(56) References Cited

U.S. PATENT DOCUMENTS 6,644,382 B1 11/2003 Aoyama

FOREIGN PATENT DOCUMENTS

| | | | |
|---|---|---|---|
| GB | 2348839 | * | 10/2000 |
| JP | 7-308751 | A | 11/1995 |
| JP | 10-29055 | * | 2/1998 |
| JP | 2000-197962 | A | 7/2000 |
| JP | 2000-301317 | A | 10/2000 |
| JP | 3128735 | B2 | 1/2001 |
| JP | 2003-305560 | A | 10/2003 |

* cited by examiner

*Primary Examiner*—Kuang Lin
(74) *Attorney, Agent, or Firm*—Arent Fox LLP

(57) ABSTRACT

A casting shakeout apparatus comprises: a first unit for vibrating a supporting member on which a casting is placed and a second unit for applying impact or vibration to the casting, wherein the second unit can move between two positions, one of which is an evacuation position for allowing the casting to be loaded and unloaded and a work position for applying impact or vibration.

11 Claims, 14 Drawing Sheets

DEVICE FOR REMOVING SAND FROM CASTING

CROSS-REFERENCE TO RELATED APPLICATION

This application is a National Stage entry of International Application Number PCT/JP2004/1003593, filed Mar. 17, 2004. The disclosure of the prior application is hereby incorporated herein in its entirety by reference.

TECHNICAL FIELD

The present invention relates to casting shakeout, in which vibration applied to a casting and a phenomenon caused in the casting by the vibration are organically linked to effectively perform the shakeout.

BACKGROUND ART

The conventional technology considered to be closest to the present invention is one disclosed in the publication of Japanese Patent No. 3128735. The principal characteristic of this technology is that one portion of a casting under a vibrating state is hit with a hammer. In this conventional technology, vibration is applied to the whole casting sand inside the casting by bringing the whole casting into a vibrating state. However, since this is not enough to separate the casting sand from the casting or to collapse the casting sand, impact is applied by a hammer to ensure satisfactory shakeout. However, the impact is applied by the hammer to only one portion of the casting, and is not applied by hitting the most effective portion. Thus, the impact applied to the casting propagates only a part of the casting, and the casting sand solidified inside the casting is only locally collapsed. Therefore, there is a problem that the casting sand over the entire portion inside the casting is not sufficiently collapsed.

DISCLOSURE OF THE INVENTION

According to one embodiment of the present invention, a casting shakeout apparatus comprises a first unit for vibrating a supporting member on which a casting is placed and a second unit for applying impact or vibration to the casting, wherein the second unit can move between two positions, one of which is an evacuation position for allowing the casting to be loaded and unloaded and a work position for applying impact or vibration.

The second unit may be a hammering apparatus for applying impact through hitting the casting.

The hammering apparatus may include a hammer attached to a swingable strut and a mechanism for swinging the strut.

The hammering apparatus can move, between the two positions of the evacuation position for allowing the casting to be loaded and unloaded and the work position for hitting the casting, parallel to a flat surface of the supporting member.

The hammering apparatus may include a base member for supporting a hammer unit and an actuator for moving the base member parallel to the flat surface of the supporting member.

The second unit may be a vibration generating unit for vibrating the casting.

The vibration generating unit may be composed of a base directly or indirectly installed in the supporting member, a magnet coil fixed to the base, and an iron piece joined to the base via an inclined plate spring.

The vibration generating unit may be composed of a base directly or indirectly installed in the supporting member, a magnet coil fixed to the base, a plate spring laterally placed parallel to the base, and an iron piece fixed to the plate spring.

The vibration generating unit may be composed of a plate spring cantilevered by the supporting member, a magnet coil fixed to the supporting member, and a hammer fixed to a free end of the plate spring.

The first unit may comprise an inclined plate spring supporting the supporting member, an iron piece fixed to the supporting member, and a magnet coil separated from the iron piece by a predetermined spacing.

The first unit may be installed in a cradle rotatably supported by a stationary frame, and a driving mechanism for rotating the cradle may be installed in the first unit.

The embodiments of the present invention will next be described in detail with reference to the drawings.

BEST MODE FOR CARRYING OUT THE INVENTION

Figure 1:
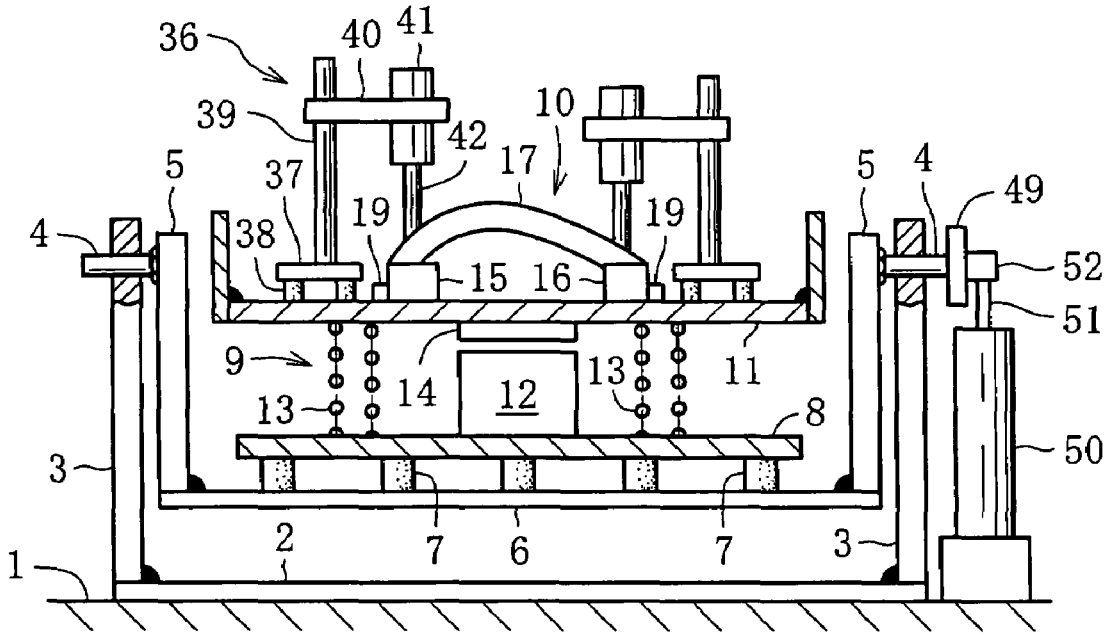
FIG. 1 is a cross-sectional view of the casting shakeout apparatus according to an embodiment of the present invention.
Figure 2:
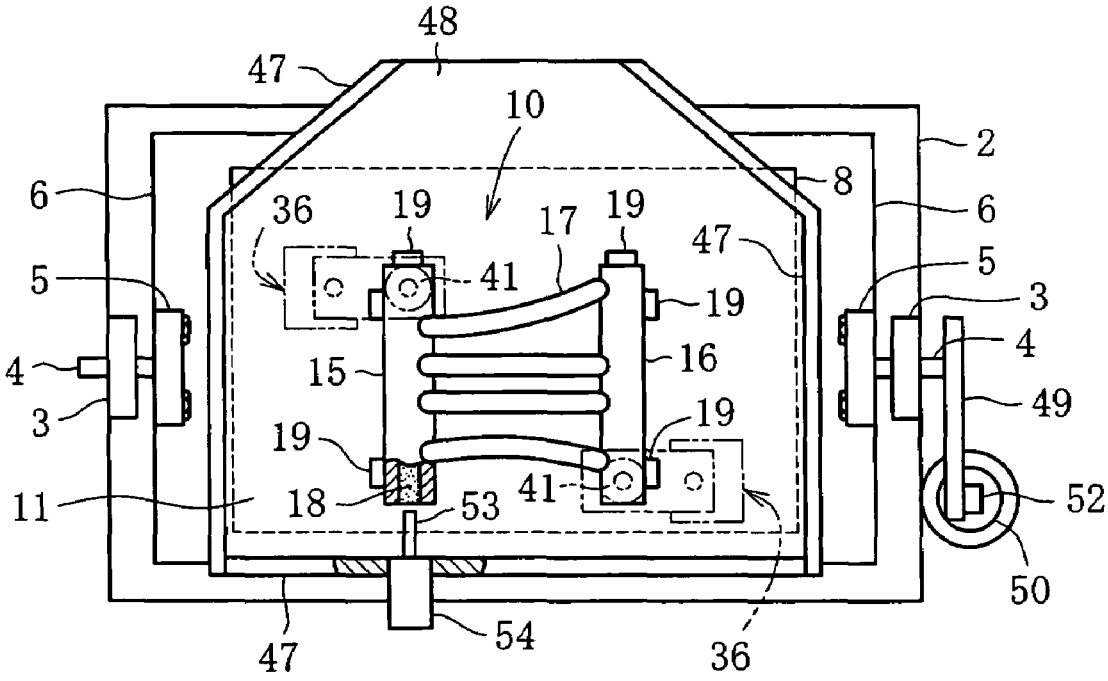
FIG. 2 is a plan view of the apparatus shown in FIG. 1.
Figure 5:
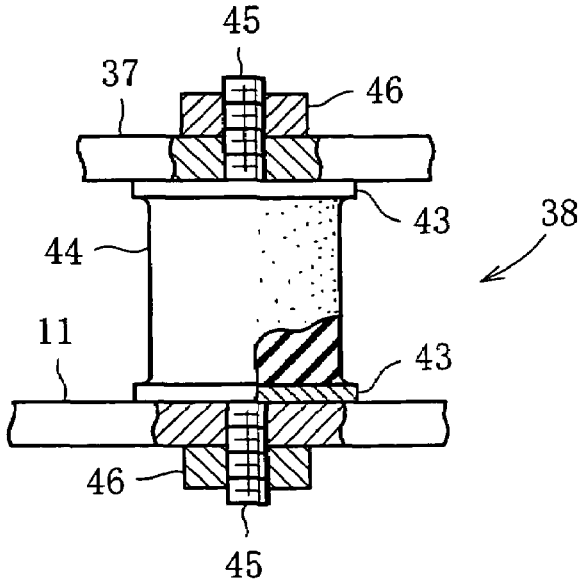
FIG. 5 is a side view showing a structure of an elastic body.

Referring to FIGS. 1 and 2, a base plate 2 made of iron is placed on floor 1, and struts 3 are firmly fixed to the left and right sides of the base plate 2 by means of welding or other method. A supporting shaft 4 is rotatably attached to the upper portion of the struts 3, and a supporting arm 5 is firmly fixed to the supporting shaft 4. A first supporting plate 6 is fixed to the lower portions of the supporting arms 5. On the upper side of the first supporting plate 6, a second supporting plate 8 is attached via a number of elastic members 7, which will be described later, as shown in FIG. 5. A vibration generating unit 9 serving as vibrating means is placed on the second supporting plate 8.

The vibration generating unit 9 continuously generates vibration, and a supporting member 11 for supporting a casting 10 is supported by the vibration generating unit 9. The vibration generating unit 9 is of a commonly employed type and is composed of an electromagnet 12 which generates an electromagnetic attractive force, spring members 13 which are placed on the second supporting plate 8 and elastically support the supporting member 11, and an iron piece 14 which is fixed to the lower surface of the supporting member 11 and serves as an attracted member. In order to facilitate the understanding, a compression coil spring is exemplarily shown in the figures as the spring member 13, but an inclined plate spring is generally employed. In FIG. 1, only two spring members 13 are shown, but, in reality, four spring members 13 are arranged so as to prevent the supporting member 11 from being inclined with respect to the second supporting member 8. The supporting member 11 is formed of a thick plate-like component and serves as a supporting plate to which the casting 10 is fixed.

Figure 6:
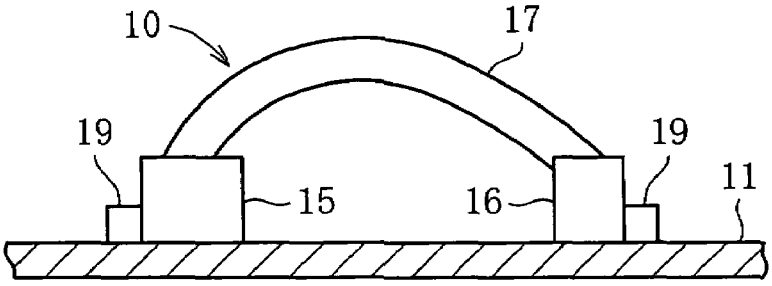
FIG. 6 is a side view of a casting.

An aluminum made intake manifold for an internal combustion engine is exemplarily shown in the figures as the casting 10. As enlarged in FIG. 6, the intake manifold is composed of an intake chamber 15, a mounting member 16 to a cylinder head, and an intake conduit 17. The inside of the intake manifold is hollow and filled with casting sand 18 serving as a core in a solidified form (see FIG. 2).

Upon intermittently applying an exciting current to the electromagnet 12 of the vibration generating unit 9, vibration with a high frequency and a very small amplitude is generated by means of the attraction of the iron piece 14 and the elastic force of the spring member 9, and is continuously applied to the casting 10 via the supporting member 11.

A number of regulating pieces 19 for preventing the casting 10 from moving to cause a displacement are fixed on the supporting member 11, and thus the casting 10 cannot move to cause a displacement. In addition, the casting 10 is pressed against the supporting member 11 through a clamp mechanism, which will be described later, shown in FIGS. 7 and 8 and is completely fixed to the supporting member 11. In order to facilitate the understanding, the clamp mechanism is not illustrated in FIGS. 1 and 2.

Figure 7:
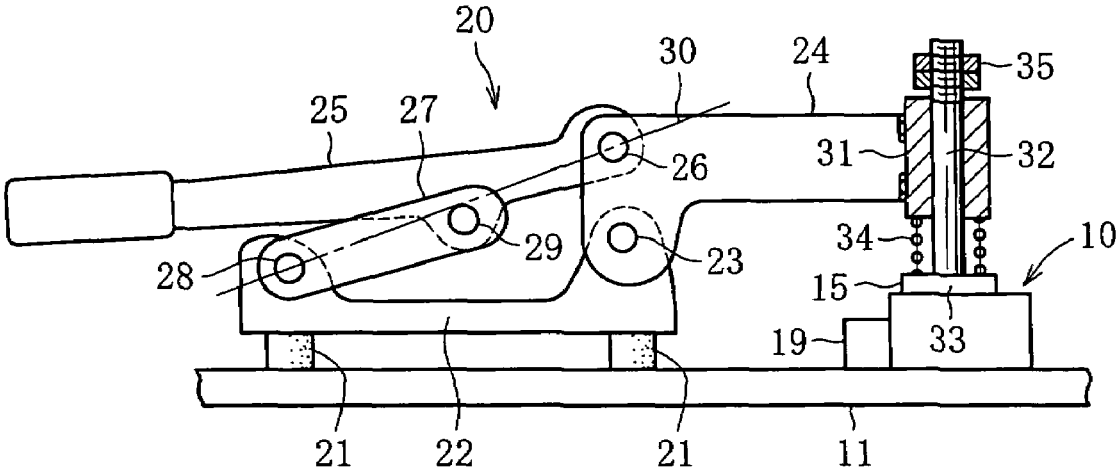
FIG. 7 is a side view of a clamp mechanism.
Figure 8:
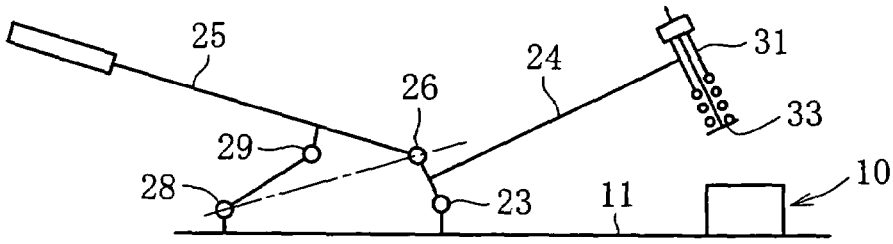
FIG. 8 is a diagrammatic view of the clamp mechanism.

The clamp mechanism 20 shown in FIGS. 7 and 8 is a commonly employed toggle type. A supporting bracket 22 is joined on the supporting member 11 via elastic bodies 21, and a clamp arm 24 is rotatably attached to one end of the supporting bracket 22 through a pivot 23. The end of an operating arm 25 which opens and closes the clamp mechanism 20 is pivotally attached to the clamp arm 24 through a pivot 26. One end of a regulation arm 27 is joined to the other end of the supporting bracket 22 through a pivot 28, and the other end of the controlling arm 27 is pivotally attached to the central part of the operating arm 25 through a pivot 29. A virtual line connecting the centers of the pivots 26 and 28 is a dead point line 30. If the pivot 29 passes the line 30, the locked state shown in FIG. 7 is achieved.

An elastic force is required to maintain such a locked state. Thus, a supporting tube 31 is welded to the end of the clamp arm 24, and a pressing piece 33 for pressing the casting 10 is fixed to a shaft 32 slidably passing through the supporting tube 31. A compression coil spring 34 is provided between the pressing piece 33 and the supporting tube 31, and a nut 35 serving as a stopper is screwed on the top end of the shaft 32. FIG. 7 shows a state in which the clamp mechanism 20 is pressing the intake chamber 15 of the casting 10. The pivot 29 has passed the dead point line 30, and this state is maintained by the spring force of the compression coil spring 34. If the operation arm 25 is rotated in the clockwise direction as shown in FIG. 8, the pressing piece 33 is moved apart from the casting 10, thereby causing the clamped state to be released.

Figure 4:
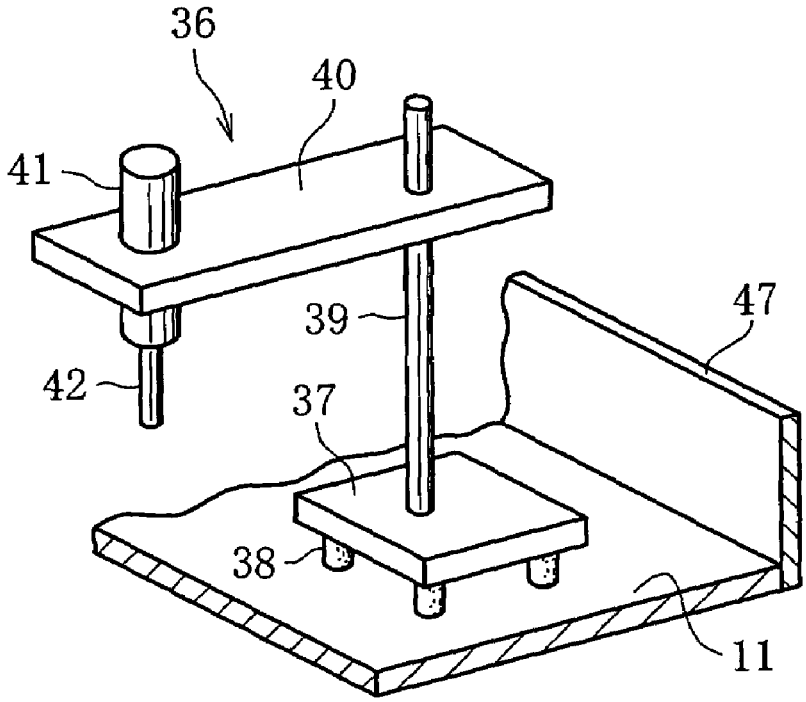
FIG. 4 is a single view drawing of a hammering apparatus.

Hammering apparatuses 36 are provided for imparting a strong impact force to the casting 10 in addition to the continuous vibration generated by the vibration generating unit 9. The hammering apparatus 36 shown in FIGS. 1, 2, and 4 is indirectly joined to the supporting member 11. A supporting plate 37 is fixed to the supporting member 11 via elastic bodies 38, and a mounting plate 40 is joined to a supporting rod 39 fixedly standing on the supporting plate 37. A driving unit 41 is fixed to the mounting plate 40, and an output shaft 42 serving as a hammer extends from the driving unit 41. The driving unit 41 imparts a strong advancing force to the output shaft 42, and the end of the output shaft 42 hits the casting 10.

Since a strong impact force acts on the casting 10 through the hammering apparatus 36, the vibration stroke length of the output shaft 42 is set to be larger than the amplitude of the vibration generating unit 9. In addition, the vibration frequency of the output shaft 42 is set to be lower than that of the vibration generating unit 9. Various types of driving unit may be employed as the driving unit 41, but an air cylinder is exemplarily shown in the figures. The output shaft 42 may be advanced and retracted by use of an electromagnetic solenoid in place of the air cylinder. Alternatively, the hammer 42 may be advanced and retracted through a reciprocal motion generated by rotating an eccentric cam by use of an electric motor.

The end of the output shaft 42 serving as a hammer is arranged so as to hit a portion of the casting sand 18 which is prone to collapse. In this manner, the collapse successively proceeds from a portion prone to collapse to a portion not prone to collapse. Alternatively, the end of the hammer 42 is arranged so as to hit a portion of the casting sand 18 which is not prone to collapse. In this case, the collapse successively proceeds from a portion not prone to collapse to a portion prone to collapse.

As is clear from FIGS. 1 and 2, the hammers 42 are placed so as to hit the end portion of the intake chamber 15 serving as one side edge of the casting 10 and the end portion of the mounting member 16 serving as the other side edge, i.e., two end portions on a diagonal line of the casting 10. Through applying the impact force of the hammer 42 to two portions consisting of a portion on one side edge and a portion on the other side edge of the casting 10 or a plurality of portions on the edges, the separation of the solidified casting sand 18 from the casting 10 and the collapse of the solidified casting sand 18 proceed successively from a plurality of the end portions to the center. Thus, the separation or the collapse is ensured to proceed over the entire casting sand 18. In addition, collapse or pulverization may be accelerated through hitting by the hammer 42, for example, around the center of the intake conduit 17, in addition to the edge portions of the casting 10, for increasing the number of the collapse initiating portions and for distributing the collapse initiating portions over the entire casting sand 18.

The plurality of portions suitable for collapse may be portions which facilitate elastic deformations of the casting 10. When the portion of the casting 10 hit by the hammer 42 is elastically deformed through the impact force applied by the hammer 42, relative displacements or distortions are generated on the joining boundary between the inner surface of the elastically deformed portion of the casting and the solidified casting sand 18 to thereby cause the casting sand 18 to separate from the inner surface of the casting 10. The separated casting sand 18 is subjected to continuous vibration and the impact force by the hammer 42. Thus, the casting sand 18 is collapsed or further pulverized and is discharged from the inside of the casting 10.

The elastic bodies 38 may be placed in any portion between the supporting member 11 and the driving unit 41. The output shaft 42 serving as the hammer of the hammering apparatus 36 is indirectly joined to the supporting member 11 via the supporting plate 37, the supporting rod 39, the mounting plate 40, and the like. Therefore, the impact reaction force of the hammering apparatus 36 is received by the supporting member 11, and the supporting member 11 is not displaced by the impact force generated by the hammering apparatus 36 itself. Thus, since the impact force and the displacement from the hammer are not transmitted to the vibrating means (the vibration generating unit 9) for vibrating the supporting member 11, the vibration means is not adversely affected and performs its normal functions. In addition, since the elastic bodies 38 are intervened, the damage of the structural members such as the supporting rod 39 and the mounting plate 40 is prevented through the absorbing action of the elastic bodies 38 even when the impact reaction force of the hammering apparatus 36 is excessively strong.

In the above description, the elastic bodies 7, 21, 38, and the like are employed, and the specific structure thereof is illustrated in FIG. 5. FIG. 5 shows the elastic body 38 provided between the supporting member 11 and the supporting plate 37. End plates 43 are vulcanized and bonded to the upper and lower portions of a cylindrical vibration isolating rubber member 44, and a bolt 45 fixed to each of the end plates 43 passes through the supporting member 11 and the supporting plate 37 and is tightened by nuts 46.

Figure 3:
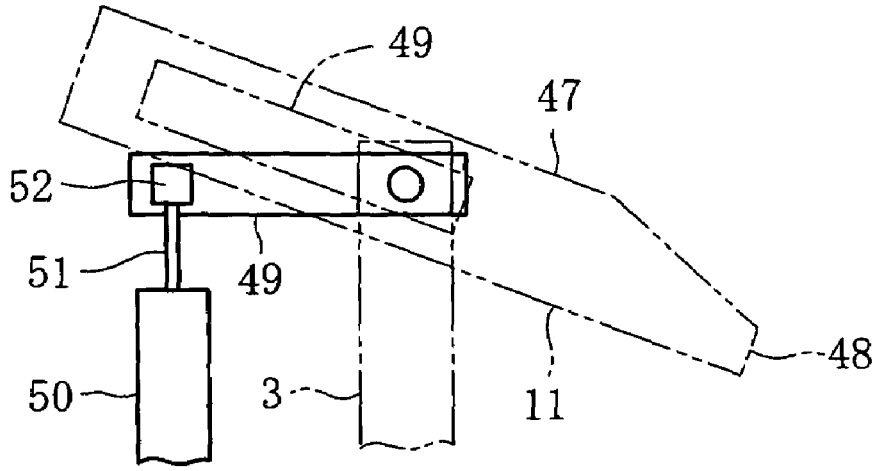
FIG. 3 is a side view showing an inclining mechanism for a supporting member.

Referring to FIGS. 1, 2, and 3, wall plates 47 are joined to the periphery of the supporting member 11 for preventing the casting sand dropped on the supporting member 11 from scattering around. Also, an outlet 48 having an opening narrowed by the wall plates 47 is formed in order to discharge the casting sand through inclining the supporting member 11. In this structure, the supporting member 11 can be inclined so as to lower the outlet 48. Specifically, a swing arm 49 is fixed to the supporting shaft 4, and a piston rod 51 of a working cylinder 50 is joined to the end of the swing arm 49 via a joint 52. The two-dot chain line in FIG. 3 represents a state in which the piston rod 51 is advanced to cause the supporting member 11 to incline.

As shown in FIG. 2, a rod-like member 53 may be inserted from an aperture of the casting 10 and advanced further into the inside of the casting 10 so as to collapse the casting sand 18 solidified around the aperture and the casting sand 18 filled further inside, thereby facilitating the collapse of the casting sand 18 inside the casting by means of vibration or impact. The rod-like member 53 performs advancing-retracting motion and is advanced and retracted by an air cylinder 54 fixed to the wall plate 47. Alternatively, a drill is employed as the rod-like member 53 and is allowed to advance into the casting sand 18 by use of an electric motor.

By advancing the rod-like member 53 into the aperture of the casting 10, the casting sand 18 filled in the aperture in a solidified state is collapsed. Further, through advancing the rod-like member 53 into the casting sand 18 further inside the casting 10, collapsibility is imparted to the casting sand 18 inside the casting. Thus, the internal casting sand 18 is allowed to move. This results in the fragmentation of the casting sand 18, and the discharge of the casting sand 18 from the casting 10 is facilitated. The collapse or the discharge is facilitated even for a complicated core form such as a cylinder block or an intake-exhaust manifold of an internal combustion engine.

Through employing the abovementioned configuration, the casting 10 receives impact forces at a plurality of portions to cause the casting sand 18 inside the casting to flake off the inner wall of the casting at a plurality of portions. At the same time, the casting sand 18 starts collapsing and is further pulverized through the continuous vibration working synergistically with the impact forces, and is discharged from the aperture of the casting. Since the impact by the hammer 42 is applied to the casting 10 at a plurality of portions, the collapse of the casting sand 18 filled in the inner space of the casting 10 is gradually spread from the plurality of portions distributed over the entire casting sand shape. After a certain time, the entire casting sand 18 is collapsed to ensure the completion of the casting sand discharge.

The supporting shaft 4 is placed on the upper part of the strut 3 serving as a stationary member. The supporting arm 5 is joined to the supporting shaft 4, and the first supporting plate 6 is fixed to the lower part of the supporting arm 5. Further, the second supporting plate 8, the vibration generating unit 9, the supporting member 11, and other members are placed on the first supporting plate 6. Thus, when the supporting arm 5 is caused to swing, the first supporting plate 6, the second supporting plate 8, the vibration generating unit 9, the supporting member 11, and other members are integrally inclined. Thus, the casting sand 18 dropped on the supporting member 11 can be easily discharged from the outlet 48. The abovementioned inclination can be obtained only by rotating the swing arm 49 fixed to the supporting shaft 4, and thus a mechanism for the rotational motion is simplified.

Figure 9:
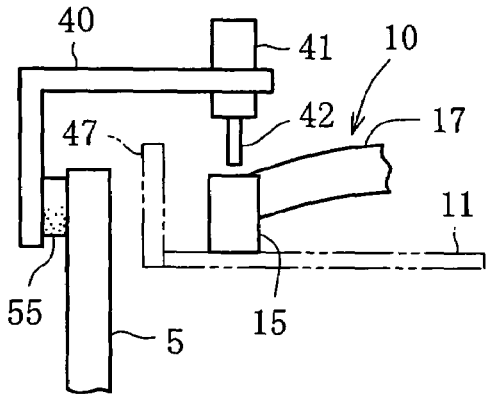
FIG. 9 is a side view showing another mounting structure of a hammer.

FIG. 9 shows a second embodiment of the present invention in which the hammer 42 is joined to a member other than the supporting member 11. In this case, an L-shaped mounting plate 40 is joined to the supporting arm 5 via an elastic body 55, and the driving unit 41 and the hammer 42 are mounted on the mounting plate 40 as in the above-described embodiment. When the casting 10 fixed to the supporting member 11 is large, the fixation position of the hammer 42 is restricted by the space available. In such a case, the space problem can be solved by joining the hammer 42 to a member other than the supporting member 11. However, the vibration generating unit 9 should not be adversely affected by the joint position of the hammer 42. Desirably, for example, the space between the vibration generating unit 9 and the supporting member 11 is set to be large.

Figure 10:
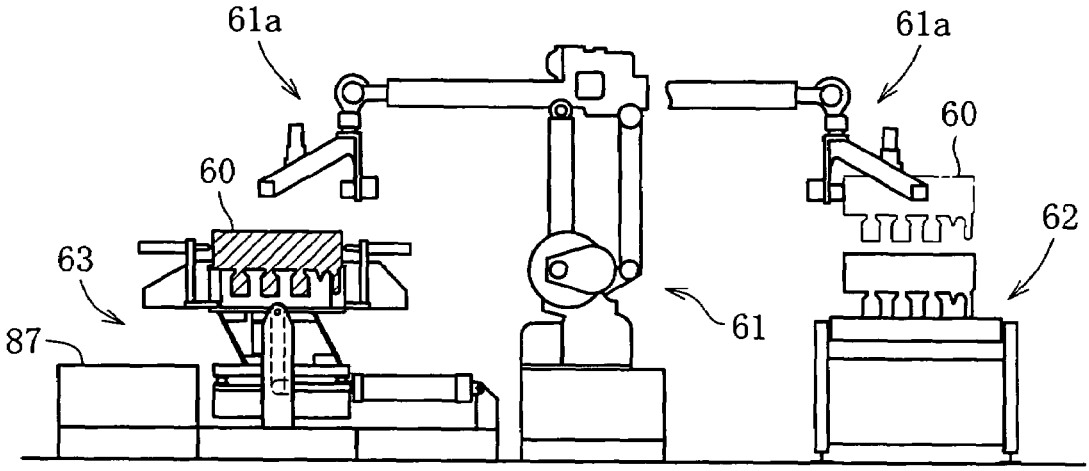
FIG. 10 is an elevational view of the entire apparatus according to another embodiment of the present invention.

Next, an embodiment shown in FIGS. 10 to 14 will be described. FIG. 10 is an elevation of the entire apparatus comprising a robot apparatus 61, a conveyer 62, and a shakeout apparatus 63. As shown in the figure, the conveyer 62 and the shakeout apparatus 63 are placed on the right side and the left side, respectively, and the robot apparatus 61 is placed therebetween. A robot arm 61*a* of the robot 61 holds a casting 60 conveyed by the conveyer 62 and loads the casting 60 into the shakeout apparatus 63. Further, the robot arm 61*a* unloads the casting 60 which has been subjected to the shakeout from the shakeout apparatus 63 to the conveyer 62. The embodiment shown in FIG. 10 is characterized in that the casting shakeout apparatus in which vibration and/or impact is imparted to a casting comprises a work position for imparting impact to the casting by means of a hammering apparatus and an evacuation position for allowing the casting to be loaded and unloaded.

As shown in FIGS. 11 to 14, a cradle 67 is supported as a pendulum between vertical members 65 of a stationary frame 64. The cradle 67 has a channel-like form and is supported by a pair of arms 68 each via a horizontal shaft 66 and is swingable with respect to the vertical member 65 of the frame 64. A cradle driving mechanism 69 is provided for reciprocally swinging the cradle 67 over a predetermined angle around the horizontal shaft 66. In this case, the cradle driving mechanism 69 is composed of an air cylinder 70 attached to the frame 64, and a piston rod 71 of the air cylinder 70 is joined to the lower portion of the cradle 67 (see FIGS. 13 and 14). A supporting plate 72 is supported by the cradle 67 via elastic bodies 73 such as vibration insulating rubber members or the like. A supporting member 74 is placed in the upper portion of the supporting plate 72, and the supporting member 74 and the supporting plate 72 are joined through plate springs 76. As can be seen from FIGS. 10, 13, and 14, the plate springs 76 are inclined at a predetermined angle. An electromagnet 77 is fixed to the upper surface of the supporting plate 72, and an iron piece 78 is fixed to the lower surface of the supporting member 74. A predetermined space is provided between the electromagnet 77 and the iron piece 78. When the electromagnet 77 is energized, the iron piece 78 is attracted by a magnetic force generated by the electromagnet 77, causing the plate springs 76 to be distorted. When the magnetic force is turned off, the iron piece 78 returns to the original position through the action of the plate springs 76. By repeating the above procedure, the supporting member 74 is reciprocally vibrated up and down in the inclined direction of the plate springs 76. Therefore, an electromagnetic vibrating conveyer having uni-directional conveyance ability is configured.

A hammering apparatus 79 for hitting the casting 60 comprises a plurality of hammer units 80 arranged in two rows, and each row of the hammer units 80 can swing between two positions of a work position in which the rows of the hammer units 80 stand upright and are arranged parallel to each other and an evacuation position in which the rows of the hammer units 80 are arranged in a V-shaped opening configuration. Each of the hammer units 80 is composed of a strut 81 which is swingably supported on the supporting member 74, and a hammer 82 held by the strut 81. A hammer retractor 83 is provided in order to swing each of the hammer units 80 between the two positions, i.e., from the work position to the evacuation position or vice versa. In this case, the hammer retractor 83 is composed of an air cylinder supported on the supporting member 74 via elastic bodies such as vibration isolating rubber members. An advancing-retracting mechanism, which allows the hammer units 80 to move parallel to the flat surface of the supporting member 74 while keeping the hammer units 80 standing upright, may be employed as the hammer retractor 83 in place of the swing mechanism which allows the struts 81, to which the hammer unit 80 is attached, to stand upright and tilt as described above. In this case, the hammer unit is attached to a movable member which can move parallel to the flat surface of the supporting member 74.

In order to fix the casting 60 mounted on the supporting member 74, a work clamp 84 is provided. In this case, the work clamp 84 is composed of a lever 85 rotatably connected to the strut 81 and an air cylinder 86 comprising a piston rod joined to the lever 85.

Figure 13:
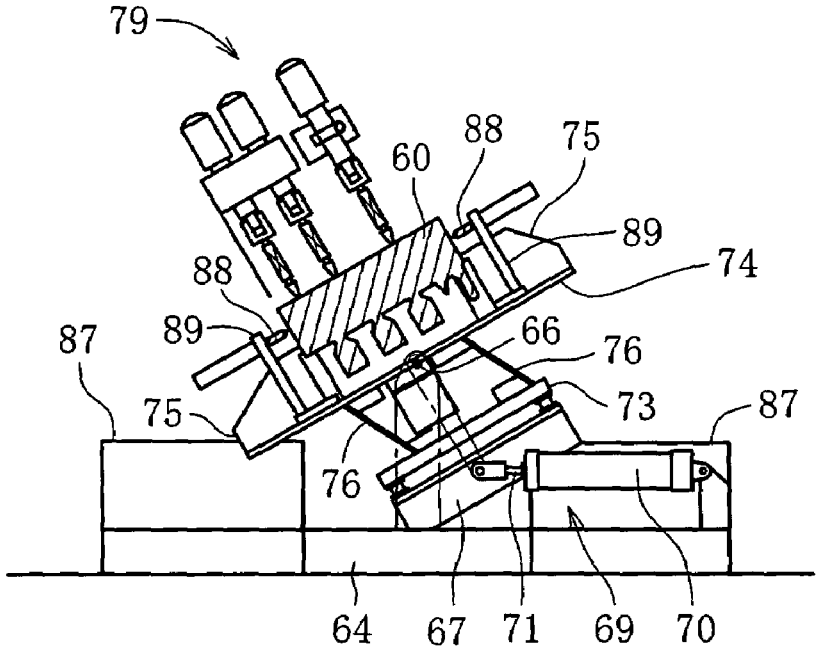
FIG. 13 is a front view of the shakeout apparatus shown in FIG. 10, in which the shakeout apparatus is in a swinging process.
Figure 14:
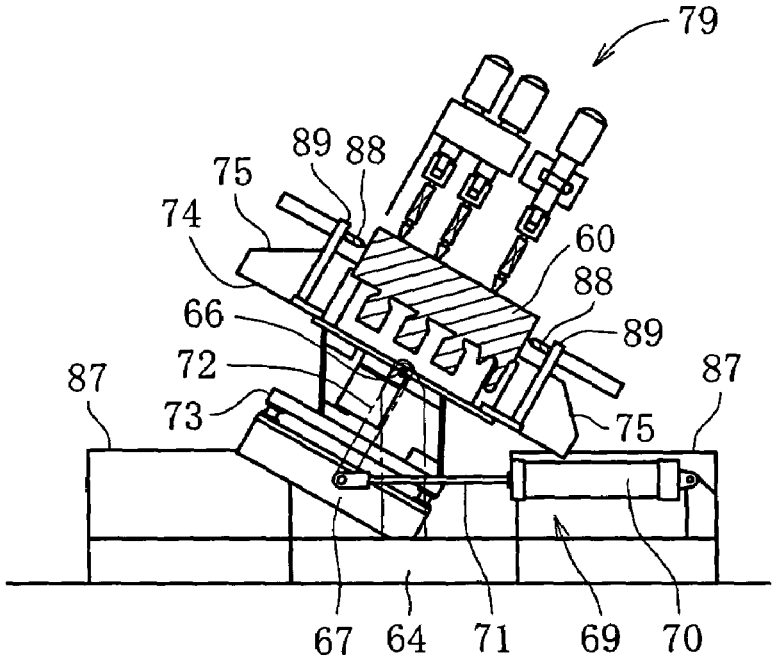
FIG. 14 is a front view of the shakeout apparatus shown in FIG. 10, in which the shakeout apparatus is in a swinging process.

As shown in FIGS. 10, 13, and 14, rod-like members 88, which are provided for poking and cleaning the casting sand filled in holes or recesses of the casting 60, are attached to the supporting member 74 each via a bracket 89. A hand carry air cylinder or an electric drill may be employed as the rod-like member 88. In this case, the rod-like member 88 may be removable with respect to the supporting member 74.

Also as shown in FIGS. 10, 13, and 14, the supporting member 74 comprises side walls 75 parallel to each other and extending in the direction perpendicular to the horizontal shaft 66. The casting sand slides and falls from an edge in which the side wall 75 is not provided or an outlet, and is received by a bucket 87 provided under the outlet. When the cradle 67 is caused to swing reversely as shown in FIGS. 13 and 14, the buckets 87 are provided on both sides.

Figure 11:
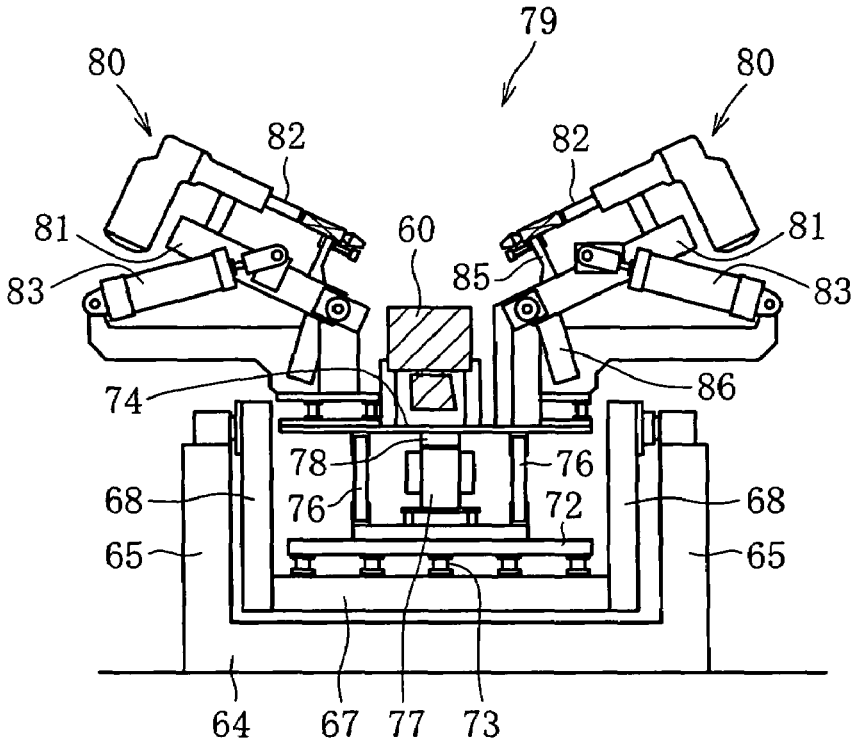
FIG. 11 is a side view of the shakeout apparatus shown in FIG. 10, in which the hammer is in an evacuation position.
Figure 12:
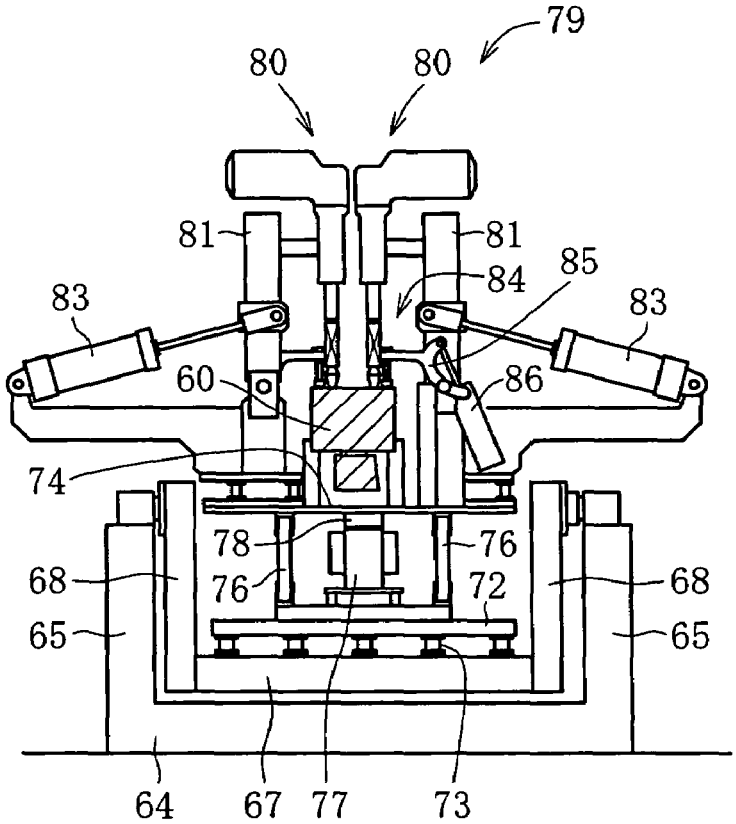
FIG. 12 is a side view of the shakeout apparatus shown in FIG. 10, in which the hammer is in a work position.

FIG. 11 is a side view of the shakeout apparatus shown in FIG. 10 and illustrating a work loading-unloading step. The hammer units 80 are evacuated not to interfere with the loading-unloading of the work or the casting 60. The loading will next be described as an example. The hammer units 80 are moved to the open evacuation position as shown in FIG. 11. In this state, the casting 60 held by the end of the robot arm 61*a* is delivered from above and placed on the supporting member 74. Upon completion of the loading of the work, the casting 60 is fixed to the supporting member 74 by the work clamps 84 as shown in FIG. 12. The hammer units 80 return to the standing upright work position, and a standby state is attained. Under the state shown in FIG. 12, the vibration generating unit (76, 77, and 78) and/or the hammering apparatus 79 is/are started up. At the same time or somewhat later, the rod-like member 88 is also started up for performing shakeout of the casting 60. The casting sand removed from the casting 60 falls and is accumulated on the supporting member 74. As has been described above, since the vibration applied to the supporting member 74 has uni-directional conveyance ability, the casting sand on the supporting member 74 is conveyed in one direction.

The cradle driving mechanism 69 allows the cradle 67 to reciprocally swing over a predetermined angle range around the horizontal shaft 66. FIG. 13 shows a state in which the cradle 67 is inclined to the left, and FIG. 14 shows a state in which the cradle 67 is inclined to the right. Normally, in an electromagnetic vibrating conveyer employing inclined plate springs, a conveyance direction is opposite to the inclination direction of the plate springs. Accordingly, the state shown in FIG. 14 represents that the swing range of the cradle 67 is specified such that the downstream of the conveyance direction on the supporting member 74 is lowered. Therefore, the casting sand slides on the supporting member 74 and falls from the inclined lower edge of the supporting member 74 toward the bucket 87. FIG. 13 represents that the swing range of the cradle 67 is specified up to a position in which the downstream of the conveyance direction on the supporting member 74 is raised. By inclining the supporting member 74 in each of the directions shown in FIGS. 13 and 14, the sand inside the casting is easily discharged from the apertures provided on both sides along the swing direction of the casting 60 regardless of the conveyance direction of the vibration generated by the vibration generating unit (76, 77, and 78).

Figure 15:
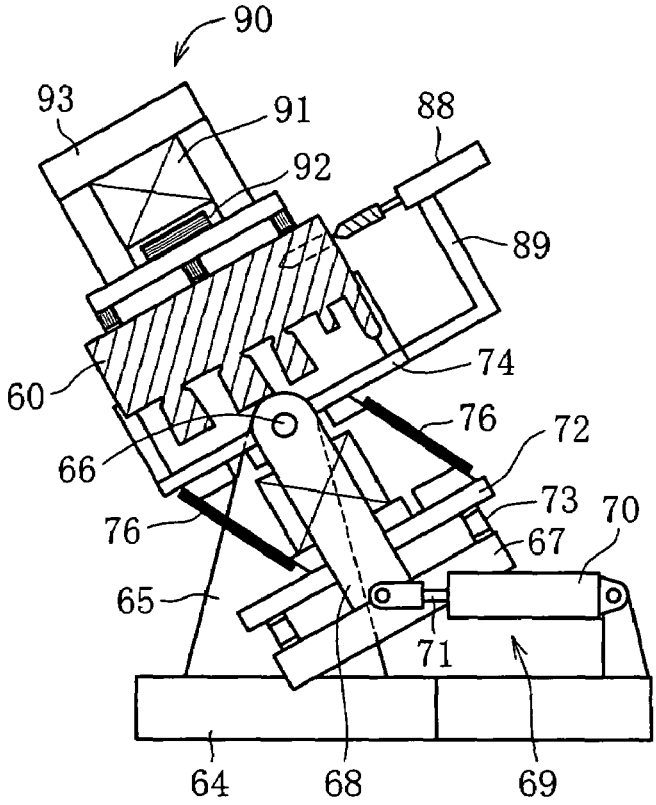
FIG. 15 is a front view of the shakeout apparatus according to yet another embodiment of the present invention.
Figure 16:
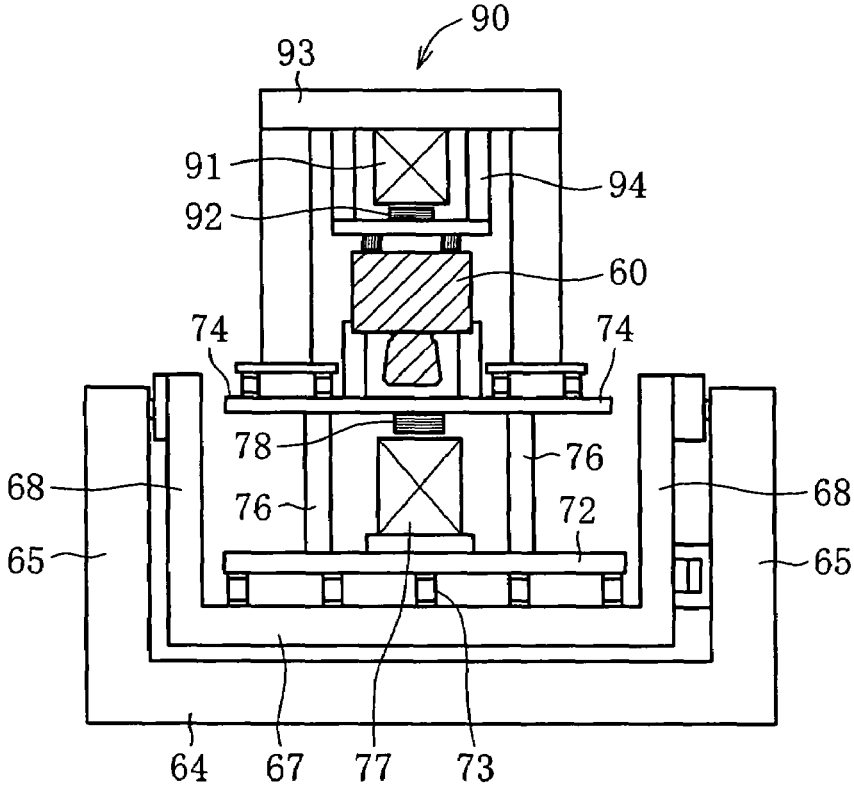
FIG. 16 is a side view of the shakeout apparatus shown in FIG. 15.

In an embodiment shown in FIGS. 15 and 16, a vibration generating unit 90 is employed in place of the hammering apparatus 79 employed in the above embodiment described in connection with FIGS. 10 to 14. The vibration generating unit 90 is composed of an electromagnet 91 and an iron piece 92 and imparts vibration to the casting 60. The electromagnet 91 is attached via elastic bodies such as vibration isolating rubber members to a base 93 fixed to the supporting member 74, and the iron piece 92 is attached to the base 93 via plate springs 94. The base 93 is mounted on the supporting member 74 as shown in the FIG. or may be mounted on the supporting plate 72 or the cradle 67. Through mounting the base 93 on a member other than the supporting member 74, the interference in the vibration by the vibration generating unit (76, 77, and 78) with the vibration by the vibration generating unit 90 is expected to be prevented or relaxed. In some cases, the resonance can be positively utilized. In any case, by adjusting the amplitude, the frequency, the timing, and the like of the vibration generated by each of the vibration generating unit, the shakeout can be satisfactorily performed while preventing cracks and flaws of the casting. In addition, since both the vibration generating units elastically apply a force to the casting via the plate springs, an excessively large force is less prone to be applied to the casting. Therefore, the casting is less likely to be damaged. In FIGS. 15 and 16, the parts and the components substantially the same as those in the configuration of the embodiment shown in FIGS. 10 to 14 above are designated by the same reference numerals.

Figure 17:
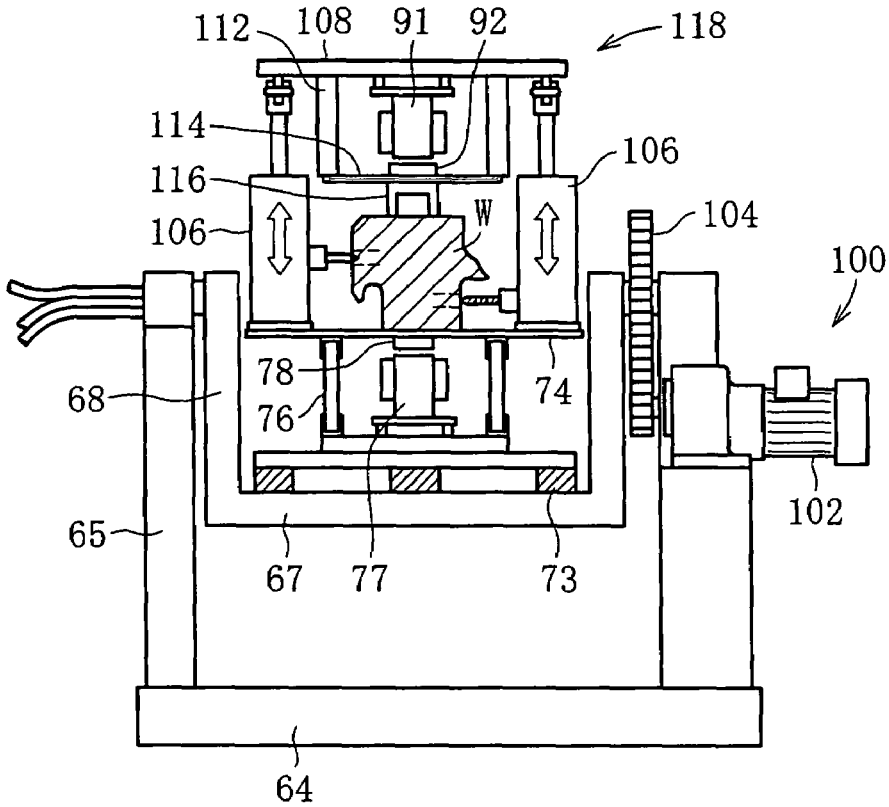
FIG. 17 is a side view of the shakeout apparatus according to still another embodiment of the present invention.
Figure 18:
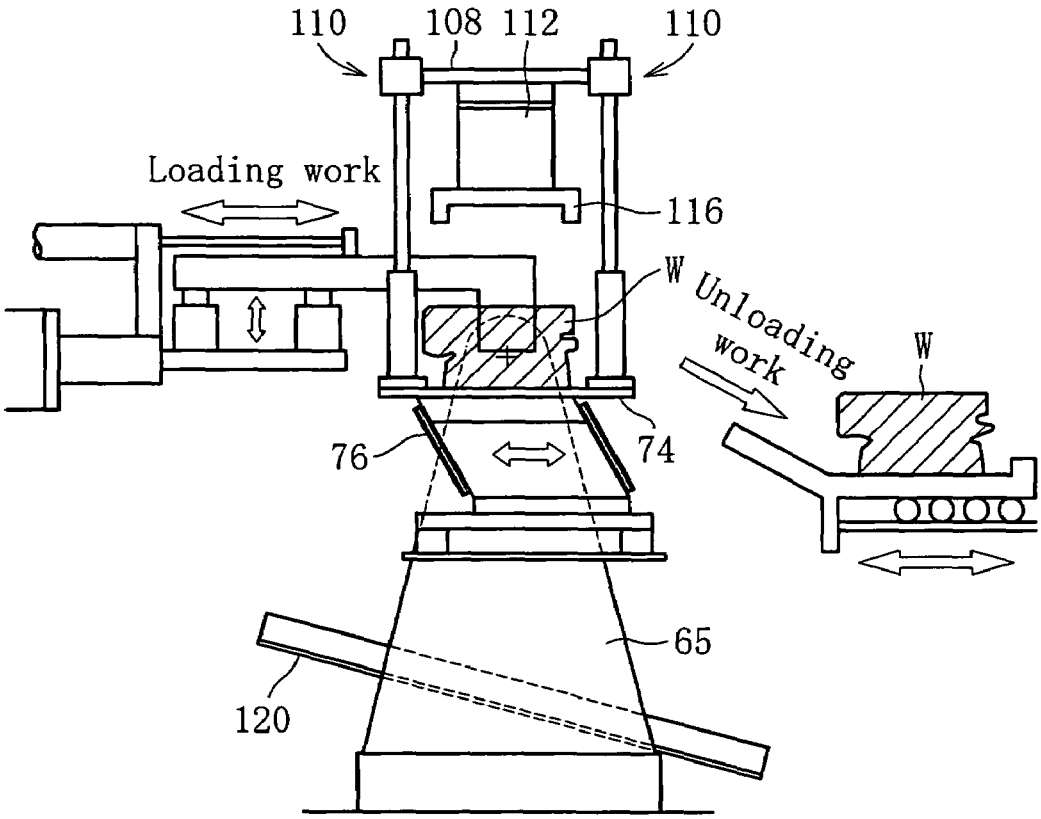
FIG. 18 is a front view of the shakeout apparatus of FIG. 17.

Next, an embodiment shown in FIGS. 17 and 18 will be described. The shakeout apparatus of this embodiment comprises, as main components, the frame 64, the cradle 67, a cradle driving mechanism 100, and a vibration generating unit (76, 77, 78; 118).

Figure 19A:
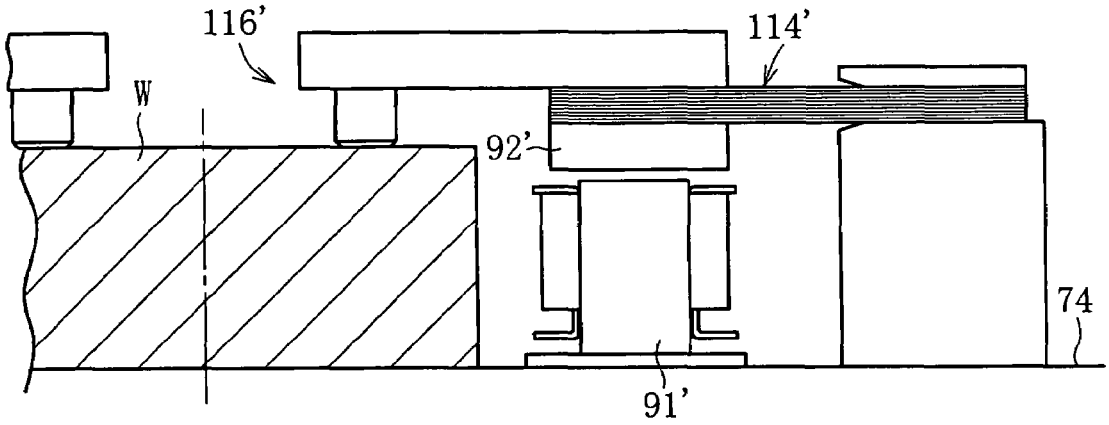
FIG. 19A is a cross-sectional view showing a modified example of the vibration generating unit.
Figure 19B:
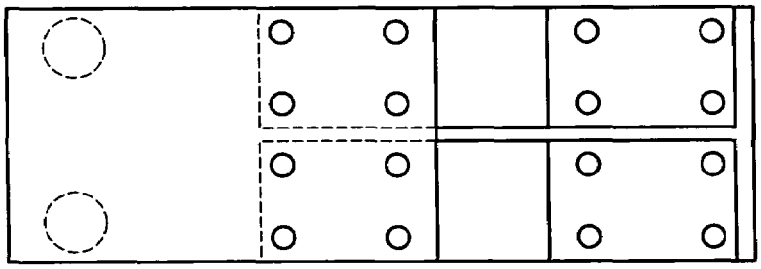
FIG. 19B is a fragmentary plan view of the vibration generating unit of FIG. 19A.

The frame 64 and the cradle 67 are substantially the same as those in the embodiment shown in FIGS. 10 to 14 above and the embodiment shown in FIGS. 15 and 16 above. In this embodiment, a motor 102 and a gear transmission mechanism 104 are employed as the cradle driving mechanism 100. The cradle 67 is rotatable through 360°, and the rotation angle can be set steplessly. As in the embodiment shown in FIGS. 15 and 16, a lower vibration generating unit and an upper vibration generating unit are provided for imparting vibration to a casting through an electromagnetic vibrator composed of an electromagnet and an iron piece. However, as will be clear from the description below, particularly, the configuration of the upper vibration generating unit is different. In other words, the configuration around the lower vibration generating unit composed of the plate springs 76, the magnet coil 77, and the iron piece 78 is not substantially different from those in the embodiment shown in FIGS. 15 and 16 above. In this case, rubber plates are exemplarily shown as one embodiment of the elastic body 73. Next, the configuration around the upper vibration generating unit 118 composed of the magnet coil 91, the iron piece 92, and a plate spring 114 will be described. A pair of air cylinders 106 is provided upright on the supporting member 74, and a base 108 is supported by the end of each piton rod of the air cylinders 106. In addition, a pair of liner guides 110 is placed in the direction perpendicular to the pair of air cylinders 106. Side plates 112 are hung down from the lower surface of the base 108, and the plate spring 114 is horizontally fixed to the lower end of the side plates 112. That is, the plate spring 114 is placed laterally between the side plates 112. The iron piece 92 is fixed to the upper surface of the plate spring 114, and an abutting plate 116 is fixed to the lower surface thereof. The vibration generated by the vibration generating unit 118 is transmitted to a work W via the abutting plate 116. As shown in FIG. 19, a configuration in which hammers 116' are fixed to respective cantilever type plate springs 114' can be employed. In this case, each of the hammers 116' abuts individually on the work W and locally transmits vibration to the work W. The reference numerals 91' and 92' designate a magnet coil and an iron piece, respectively.

Figure 20A:
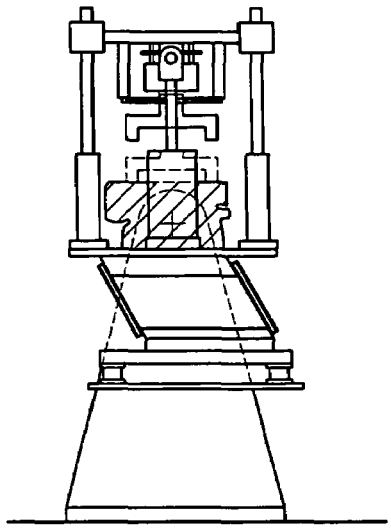
FIGS. 20A to 20D are process drawings for describing the operation of the shakeout apparatus of 17.
Figure 20B:
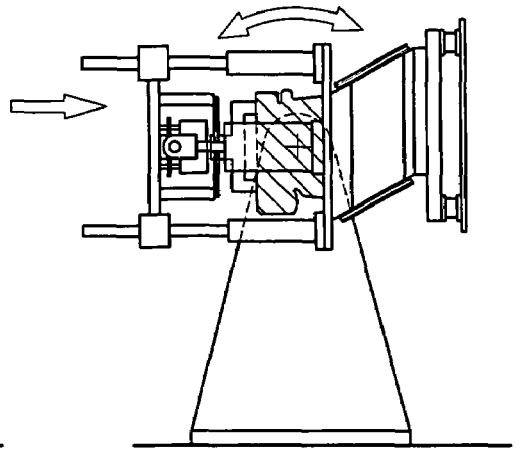
Figure 20C:
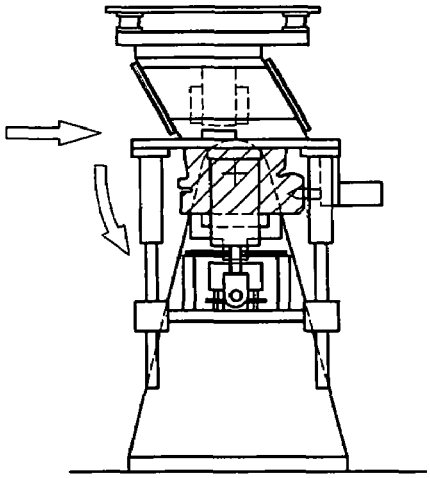
Figure 20D:
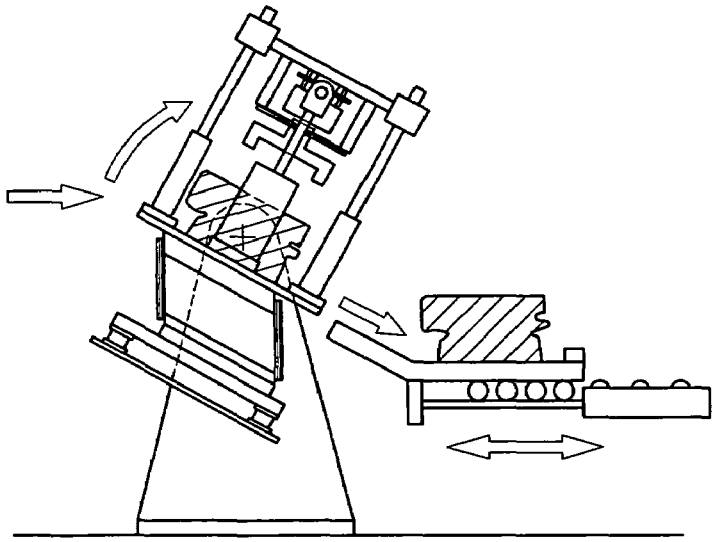

The action of this embodiment will next be described. First, as shown in FIG. 20A, the lower vibration generating unit (76, 77, and 78) and the upper vibration generating unit 118 are started up for performing the shakeout while the casting is in an upwardly oriented state (step 1). Subsequently, as shown in FIG. 20B, the cradle 67 is rotated to the left by 90° for performing the shakeout while the work W is in a laterally oriented state (step 2). Subsequently, the cradle 67 is rotated to the right by 90° for performing the shakeout while the work W is in a laterally oriented state (step 3). Further, as shown in FIG. 20C, the cradle 67 is rotated by 180° for performing the shake while the work W is in a downwardly oriented state (step 4). Upon completion of steps 1 to 4, loading and unloading of the work W are carried out as shown in FIG. 20D (step 5). Specifically, the work W which has been subjected to the shakeout is unloaded, and a new work W is loaded. In step 5, as shown in FIG. 18 the piton rod of the air cylinder 106 advances to cause the abutting plate 116 to separate away from the work W, thereby facilitating the unload of the work W. After a new work W is loaded and placed on the supporting plate 74, the piston rod of the air cylinder 106 is retracted to cause the abutting plate 116 to abut on the work W. As described above, the work W is in a clamped state during the shakeout and thus is less prone to being displaced, thereby preventing the possibility of applying impact to an unintended portion.

Figure 21B:
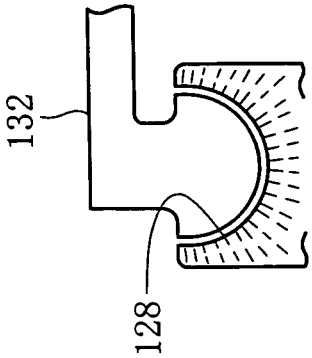
FIG. 21B is a cross-sectional view of a blade and a trough of FIG. 21A.
Figure 21A:
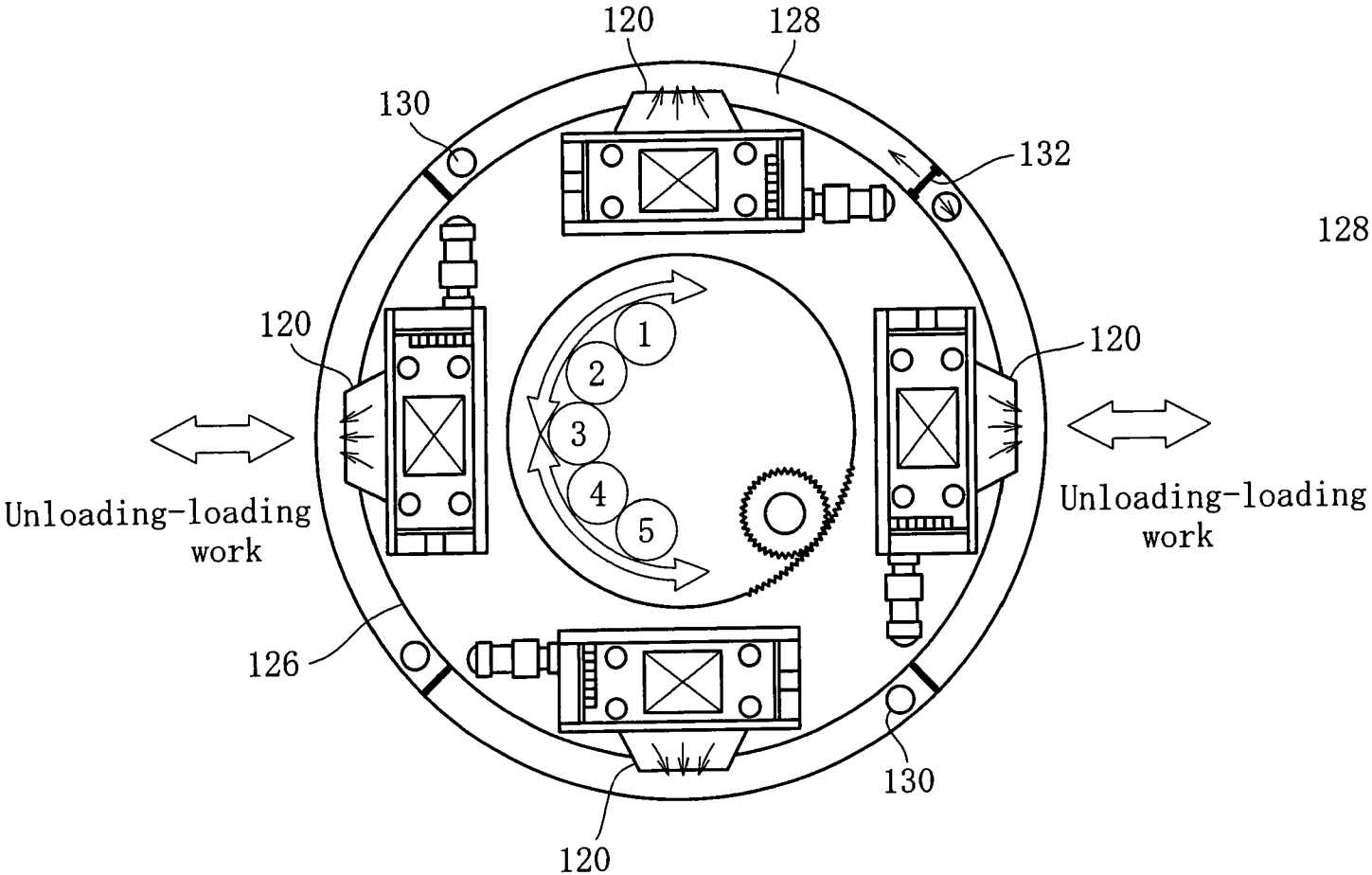
FIG. 21A is a plan view showing an installation example of the shakeout apparatus of FIG. 17.

As shown in FIGS. 21A and 21B, in order to efficiently perform the above-described steps 1 to 5, four shakeout apparatuses are placed on a turntable 126. While step 5 or the unloading-loading of a work is performed in one shakeout apparatus, steps 2 to 4 are performed in the other shakeout apparatuses. During one rotation of the turntable 126, each of the shakeout apparatuses completes steps 1 to 4 to perform step 5. In this case, the shakeout time for one work can be extended, and thus the sufficient shakeout can be expected even when relatively small amplitude which may not cause the casting to be cracked or flawed is employed.

A trough 128 is provided in the outer periphery of the turntable 126. As shown in FIG. 18, an inclined chute 120 is provided in each of the shakeout apparatuses. In the embodiment shown in FIG. 21A, the lower end of the chute 120 is positioned above the trough 128. Thus, the sand having fallen from the work W travels along the chute 120 and falls into the trough 128. A through hole 130 is drilled in several points along the circumferential direction of the trough 128. On the other hand, a blade 132 having a shape fitting to the trough 128 is attached to the turntable 126. This blade 132 travels along the trough 128 together with the rotation of the turntable 126 and sweeps inside the trough 128 to collect the sand. The thus-collected sand falls from the through hole 130 and is collected in a container (not shown) placed below the through hole 130.

Figure 22:
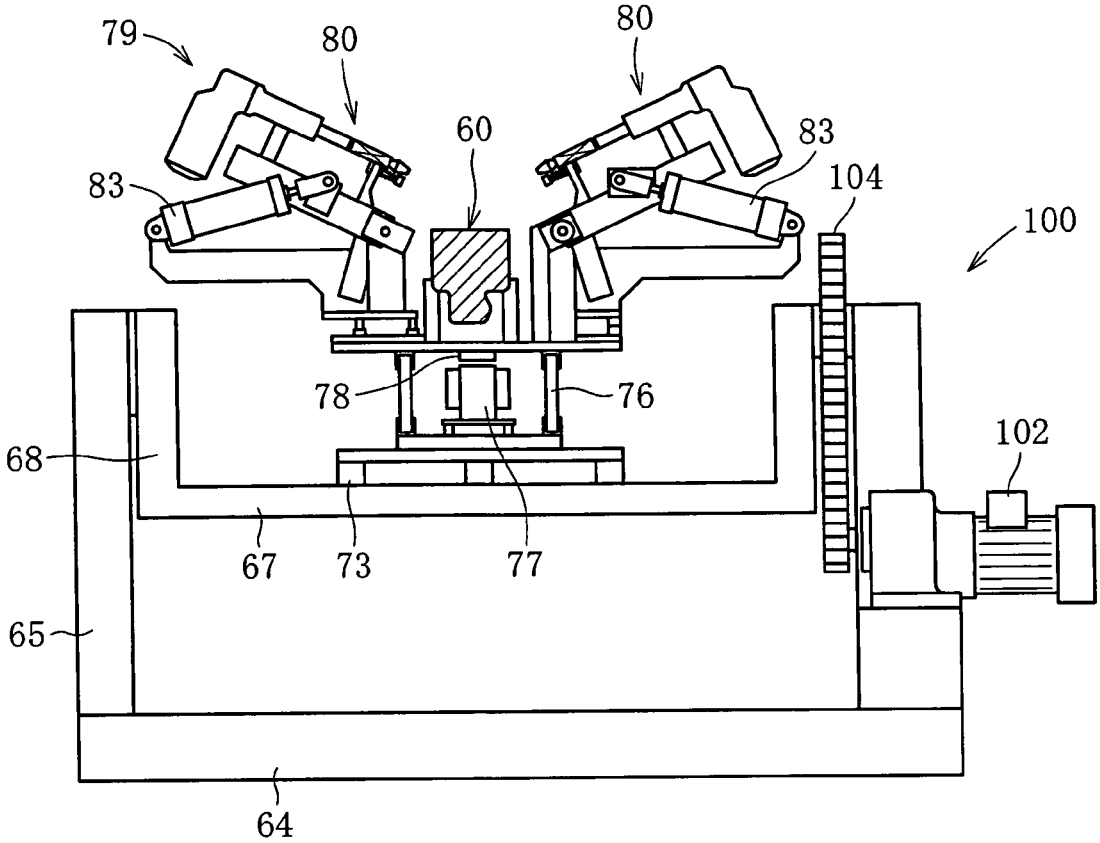
FIG. 22 is a side view of the shakeout apparatus according to yet still another embodiment of the present invention.
Figure 23:
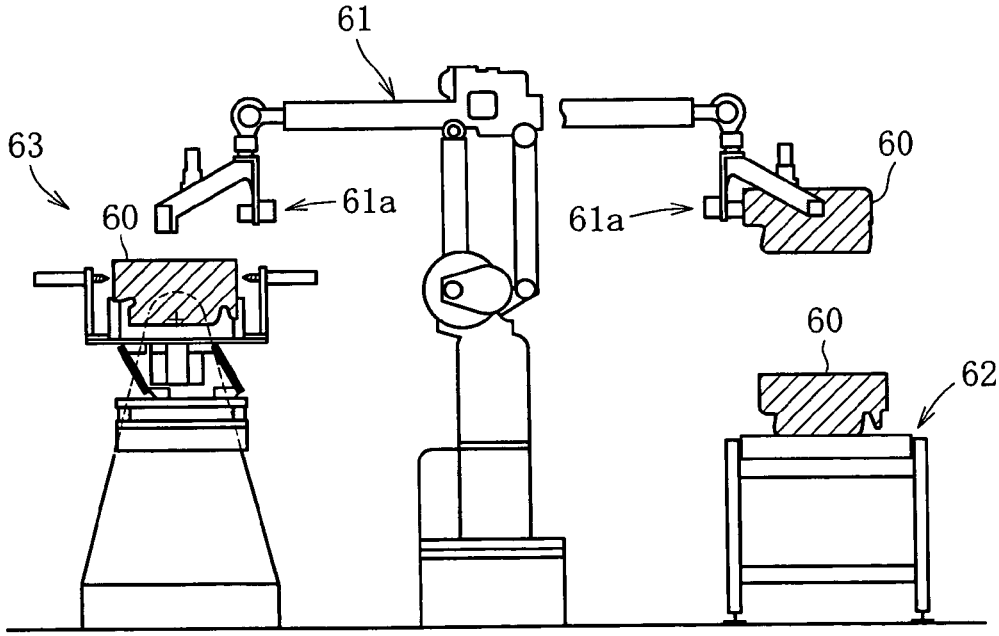
FIG. 23 is a front view of the shakeout apparatus of FIG. 22.
Figures 24A, 24B, 24C:
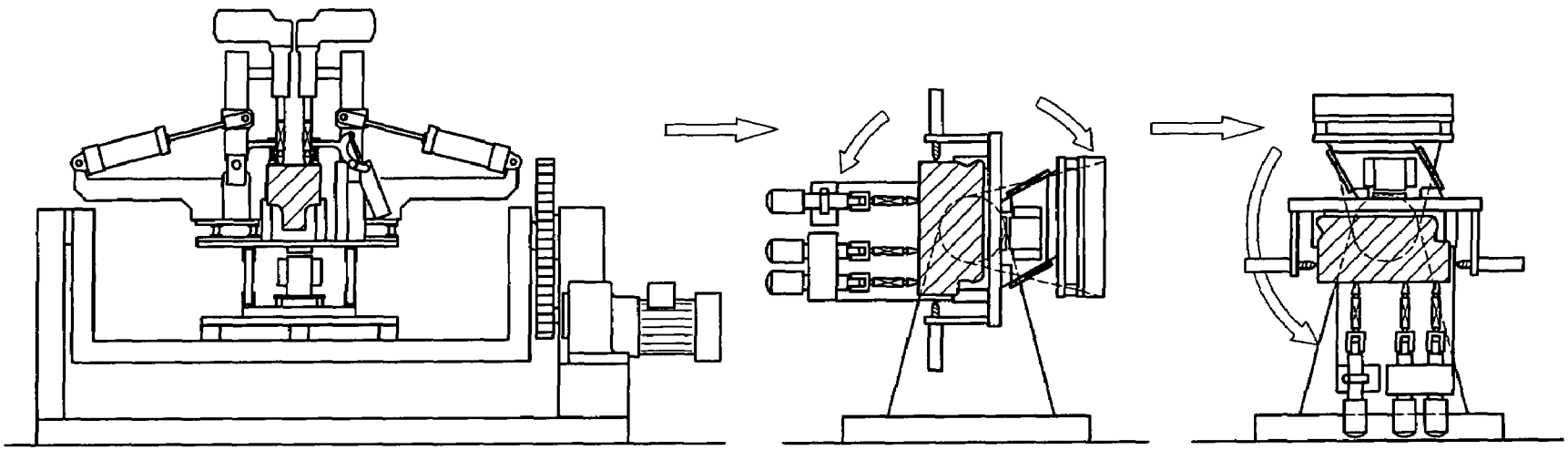
FIGS. 24A to 24C are process drawings similar to FIGS. 20A to 20D.

Almost the same steps as the shakeout steps described with reference to FIGS. 20A to 20D can be employed in the embodiment shown in FIGS. 10 to 14. FIGS. 22 and 23 show a shakeout apparatus employed in such a case. FIG. 22 corresponds to FIG. 11, and FIG. 23 corresponds to FIG. 10. In these figures, substantially the same parts and components are designated by the same reference numerals. As is clear from a comparison of these figures, the only difference is that the motor 102 and the gear transmission mechanism 104 are employed as the cradle driving mechanism 100 in the embodiment of FIGS. 22 and 23. The operation of the embodiment shown in FIGS. 22 and 23 is illustrated in process drawings of FIGS. 24A to 24C. Specifically, as shown in FIG. 24A, the hammering apparatus 79 and the vibration generating unit (76, 77, and 78) are first started up for performing the shakeout while the work 60 is in an upwardly oriented state (step 1). Subsequently, as shown in FIG. 24B, the cradle 67 is rotated to the left by 90° for performing the shakeout while the work is in a laterally oriented state (step 2). Subsequently, the cradle 67 is rotated to the right by 90° for performing the shakeout while the work is in a reversely laterally oriented state (step 3). Further, as shown in FIG. 24C, the cradle 67 is rotated by 180° for performing the shakeout while the work is in a downwardly oriented state (step 4).

Figure 25:
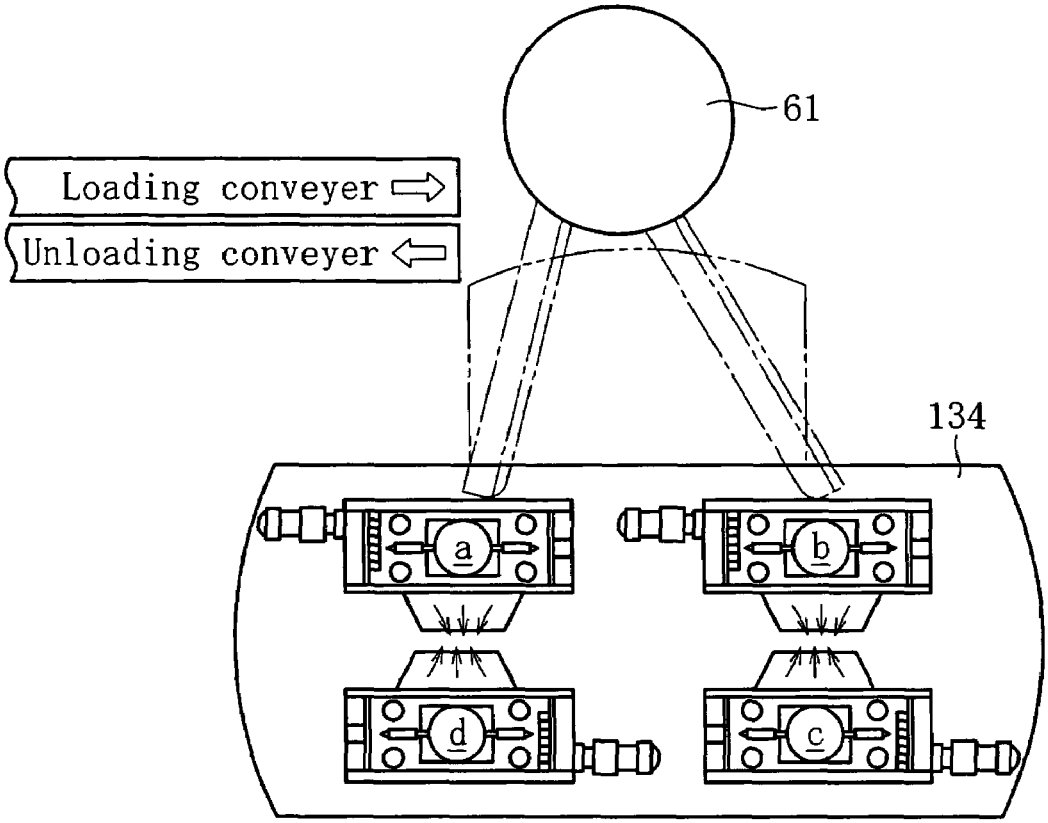
FIG. 25 is a plan view similar to FIG. 21A.

For example, four shakeout apparatuses a to d are placed on a turnaround table 134 shown in FIG. 25. While the work unloading-loading step is carried out in the shakeout apparatus a by means of the work unloading-loading robot 61, the shakeout apparatuses b to d perform steps 1 to 4. When the shakeout apparatus b performs the work unloading-loading step, the shakeout apparatuses a, c, and d perform steps 1 to 4. Subsequently, the turnaround table 134 turns around. While the shakeout apparatus c performs the work unloading-loading step, the shakeout apparatuses a, b, and d perform steps 1 to 4. While the shakeout apparatus d performs the work unloading-loading step, the shakeout apparatuses a to c perform steps 1 to 4.

Figure 26:
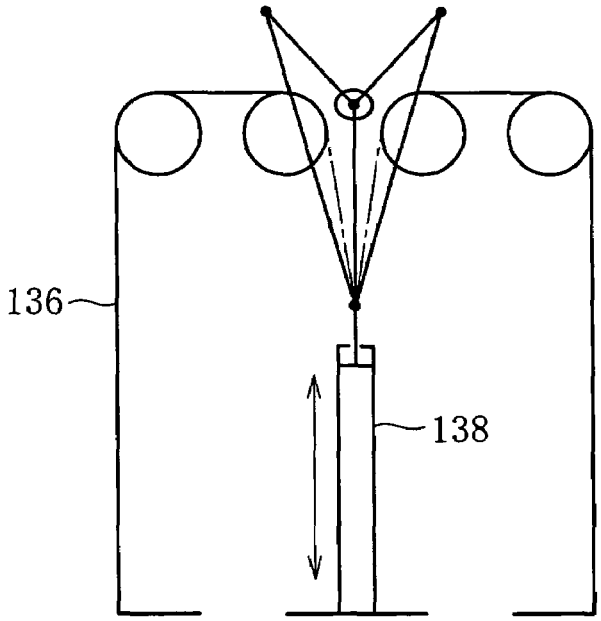
FIG. 26 is a schematic cross-sectional view of a cover.

As shown in FIG. 26, the shakeout apparatuses are preferably covered individually or as a whole with a caver 136 for soundproofing and dustproofing. In the case of the cover 136 exemplarily shown in FIG. 26, the cover 136 is opened and closed by means of an air cylinder 138, and the open-close stroke of the cover 136 is twice the stroke of the air cylinder 138.

The invention claimed is:

1. A casting shakeout apparatus comprising:

a first unit for vibrating a supporting member on which a casting is placed; and a second unit for applying impact or vibration to the casting, wherein the second unit is movable between two positions, a first position which is an evacuation position for allowing the casting to be loaded and unloaded and a second position which is a work position for applying impact or vibration, and wherein the second unit is disposed directly on and is only supported by first and second pairs of elastic members that are attached to and extend orthogonally from a planar surface of the supporting member, the first and second pairs of elastic members having a longitudinal axis beginning at the planar surface and terminating at the second unit, wherein the longitudinal axis of the first pair of elastic members is parallel to the longitudinal axis of the second pair of elastic members.

2. The casting shakeout apparatus according to claim 1, wherein the second unit is a hammering apparatus for applying impact through hitting the casting.

3. The casting shakeout apparatus according to claim 2, wherein the hammering apparatus includes a hammer attached to a swingable strut and a mechanism for swinging the strut.

4. The casting shakeout apparatus according to claim 2, wherein the hammering apparatus is movable, between the evacuation position for allowing the casting to be loaded and unloaded and the work position for hitting the casting, perpendicularly relative to the planar surface of the supporting member.

5. The casting shakeout apparatus according to claim 4, wherein the hammering apparatus includes a base member for supporting a hammer unit and an actuator for moving the base member perpendicularly relative to the planar surface of the supporting member.

6. The casting shakeout apparatus according to claim 1, wherein the second unit is a vibration generating unit for vibrating the casting.

7. The casting shakeout apparatus according to claim 6, wherein the vibration generating unit comprises a base directly or indirectly positioned on the supporting member, a magnet coil fixed to the base, and an iron piece joined to the base via an inclined plate spring.

8. The casting shakeout apparatus according to claim 6, wherein the vibration generating unit comprises a base directly or indirectly positioned on the supporting member, a magnet coil fixed to the base, a plate spring laterally placed parallel to the base, and an iron piece fixed to the plate spring.

9. The casting shakeout apparatus according to claim 6, wherein the vibration generating unit comprises a plate spring cantilevered by the supporting member, a magnet coil fixed to the supporting member, and a hammer fixed to a free end of the plate spring.

10. The casting shakeout apparatus according to claim 1, wherein the first unit comprises an inclined plate spring supporting the supporting member, an iron piece fixed to the supporting member, and a magnet coil separated from the iron piece by a predetermined spacing.

11. The casting shakeout apparatus according to claim 10, wherein the first unit is installed in a cradle rotatably supported by a stationary frame, and a driving mechanism for rotating the cradle is installed in the first unit.

* * * * *